US008256662B2

(12) United States Patent
Grassia et al.

(10) Patent No.: US 8,256,662 B2
(45) Date of Patent: Sep. 4, 2012

(54) FILE WITH MULTIPLE LABELED POCKETS

(75) Inventors: Lauren Grassia, East Northport, NY (US); Juliet Kenney, New York, NY (US); Adam Martin, Union, MO (US); Braden Jones, Phoenix, AZ (US); Doug Hibler, Union, MO (US)

(73) Assignee: Esselte Corporation, Melville, NY (US)

( * ) Notice: Subject to any disclaimer, the term of this patent is extended or adjusted under 35 U.S.C. 154(b) by 63 days.

(21) Appl. No.: 12/831,709

(22) Filed: Jul. 7, 2010

(65) Prior Publication Data

US 2011/0210159 A1 Sep. 1, 2011

(51) Int. Cl.
*B65D 27/00* (2006.01)
*B65D 27/08* (2006.01)

(52) U.S. Cl. ..... 229/67.1; 229/72; 402/500

(58) Field of Classification Search ..... 229/67.1, 229/72; 402/500

See application file for complete search history.

(56) References Cited

U.S. PATENT DOCUMENTS

| | | | | | |
|---|---|---|---|---|---|
| 601,922 | A | * | 4/1898 | Wieland | 150/132 |
| 1,484,827 | A | * | 2/1924 | Heend | 40/537 |
| 1,572,239 | A | * | 2/1926 | Low | 229/67.1 |
| 1,922,213 | A | | 8/1933 | Middleton | |
| 2,161,015 | A | | 6/1939 | Buxton | |
| 2,280,889 | A | * | 4/1942 | Buxton | 150/149 |
| 3,154,125 | A | | 10/1964 | Harvey | |
| 3,668,979 | A | * | 6/1972 | Cariven | 493/384 |
| 3,740,879 | A | | 6/1973 | Patterson | |
| 3,839,809 | A | | 10/1974 | Casas et al. | |
| 3,858,790 | A | | 1/1975 | Humphrey | |
| 3,970,130 | A | | 7/1976 | Casey | |
| 4,004,690 | A | * | 1/1977 | Giarritta | 206/425 |
| 4,055,008 | A | * | 10/1977 | Bell | 40/405 |
| 4,109,850 | A | | 8/1978 | Meenan et al. | |
| 4,575,126 | A | | 3/1986 | Grubbs | |
| 4,639,157 | A | * | 1/1987 | Herzfeld | 402/19 |

(Continued)

FOREIGN PATENT DOCUMENTS

JP 2000343866 12/2000

(Continued)

OTHER PUBLICATIONS

Non-Final Office Action issued on Sep. 29, 2011 for U.S. Appl. No. 12/566,872.

(Continued)

*Primary Examiner* — Nathan J Newhouse
*Assistant Examiner* — Derek Battisti
(74) *Attorney, Agent, or Firm* — Dorsey & Whitney LLP

(57) ABSTRACT

A file having first and second cover panels pivotally connected to each other at a hinge for movement between an open and closed position may be provided. The cover panels can overlap each other in the closed position to contain papers of a predetermined size therebetween. One or more superimposed pocket panels can be coupled to an inside of the first cover panel to define overlapping pockets dimensioned to hold the papers. The pocket panels can have first edge portions that define openings to the pockets, and the first edge portions can be staggered. The pocket panels may include an outermost pocket panel with an additional coupled edge. A labeling member can be provided that is associated with each pocket panel and configured for displaying identification information. The labeling members can extend beyond papers held in the pockets and can comprise tabs that can be staggered from each other.

32 Claims, 16 Drawing Sheets

U.S. PATENT DOCUMENTS

| | | | | |
|---|---|---|---|---|
| 4,852,740 | A * | 8/1989 | Sellar et al. | 206/308.3 |
| 5,540,513 | A | 7/1996 | Wyant | |
| 5,586,829 | A | 12/1996 | Schwartz | |
| 5,732,977 | A * | 3/1998 | Kohana | 281/45 |
| 5,913,540 | A * | 6/1999 | Ong | 281/31 |
| 6,182,827 | B1 | 2/2001 | Su | |
| 6,209,778 | B1 | 4/2001 | Henrikson et al. | |
| 6,409,409 | B2 | 6/2002 | Bauman et al. | |
| 6,453,589 | B1 | 9/2002 | Schwartz | |
| 6,543,379 | B2 | 4/2003 | Schwartz | |
| 6,679,418 | B1 * | 1/2004 | Schwartz | 229/67.4 |
| 6,695,519 | B2 * | 2/2004 | Tims et al. | 402/73 |
| 6,974,274 | B2 | 12/2005 | Sapienza et al. | |
| 7,275,769 | B2 | 10/2007 | Mills | |
| 7,306,134 | B1 | 12/2007 | Ong | |
| D602,080 | S * | 10/2009 | Takaghi | D19/27 |
| 7,780,369 | B2 * | 8/2010 | Penn et al. | 402/79 |
| 2006/0060641 | A1 | 3/2006 | Taylor | |
| 2006/0216108 | A1 | 9/2006 | Busam et al. | |
| 2009/0152153 | A1 | 6/2009 | Bettinger | |

FOREIGN PATENT DOCUMENTS

| | | |
|---|---|---|
| JP | 2005178286 | 7/2005 |
| JP | 2005185789 | 7/2005 |
| JP | 2006024435 | 1/2006 |
| JP | 2009295488 | 12/2009 |
| KR | 20030091608 | 12/2003 |

OTHER PUBLICATIONS

International Search Report for PCT/US2010/050044 mailed Jun. 3, 2011.

International Written Opinion for PCT/US2010/050044 mailed Jun. 3, 2011.

* cited by examiner

FILE WITH MULTIPLE LABELED POCKETS

FIELD OF THE INVENTION

The present invention relates to a file with pockets.

BACKGROUND INFORMATION

Files commonly have been used to organize papers and groups of papers. Simple forms of files typically have a front and back cover, often made of a single piece of semi-rigid paper or plastic that is bent so that the front cover folds up against the back cover. Tabs are provided in varying locations on files.

Some known mechanisms to keep papers from falling out of the closed file include pockets. Pockets are generally made from additional material that is attached to the file. U.S. Pat. No. 6,453,589 for example shows a file folder with a clear paneled portion front cover, a flap retaining tab and slot, and a retaining panel for locking the folding portion of the front panel.

There is a need for a file with improved access to superimposed pockets, such as with improved labeling.

SUMMARY

According to various exemplary embodiments of the present invention, a file is provided, that can have first and second cover panels pivotally connected to each other at a hinge for movement between an open and closed position, whereas the cover panels can overlap each other in the closed position to contain papers of a predetermined size therebetween. The file can have a plurality of superimposed pocket panels disposed on an inside of the first cover panel to define overlapping pockets, the pocket panels being arranged and dimensioned to hold the papers so that the papers in the pockets are covered by the overlapping cover panels in the closed position, wherein the pocket panels have first edge portions that define openings to the pockets, the first edge portions being staggered with respect to one another, each pocket panel having a first connected portion that is connected to provide a first closed side of the respective pocket. The plurality of pocket panels can include an outermost pocket panel with a second connected portion connected to the cover panel to form a second closed side of at least one of the pockets. The file can have a labeling member disposed in association with each pocket panel and configured for displaying identification information adjacent the respective pocket, the labeling members being positioned to extend beyond the papers held in the overlapping pockets.

According to various exemplary embodiments, the labeling members can have pocket tabs extending from the pocket panels, wherein the pocket tabs are staggered from each other such that each of the pocket tabs is visible with the pockets closed. The file can have a file tab extending from at least one of the cover panels, wherein the pocket tabs are a different shape or size than the file tab to provide a visual distinction therefrom. The file tab can also have a file tab extending from at least one of the cover panels, wherein the file tab and pocket tabs extend in a same direction from the closed file, and the pocket tabs are shorter along the same direction than the file tab. The pocket tabs can extend across the hinge to the other of the cover panels.

According to various exemplary embodiments, the file can have labeling members that are disposed on the second cover panel adjacent the staggered edge portions of the respective pocket panels that protrude from a pocket panel overlapped thereover. The pocket panels can each define a notch configured and dimensioned for receiving a finger to facilitate lifting each pocket panel to open the pocket defined thereby. The first edge portions can be staggered in a direction generally parallel to the hinge. The pocket panels can be coiled around a common spine, which can be affixed to the first covers at opposite sides thereof. The file can be made from a single, unitary blank According to various exemplary embodiments, a file can be provided having first and second cover panels pivotally connected to each other at a hinge for movement between an open and closed position, the cover panels overlapping each other in the closed position to contain papers of a predetermined size therebetween. The file can have a plurality of superimposed pocket panels disposed on an inside of the first cover panel to define overlapping pockets, the pocket panels arranged and dimensioned to hold the papers so that the papers in the pockets are covered by the overlapping cover panels in the closed position. The pocket panels can have first edge portions that define openings to the pockets, the first edge portions being staggered with respect to one another in a direction generally parallel to the hinge, the pocket panels being connected portion with respect to the first cover panel to provide a first closed side of the pockets, and the plurality of pocket panels including an outermost pocket panel with a second connected portion connected to the cover panel to form a second closed side of at least one of the pockets. The file can have a pocket tab extending from each of the pocket panels and configured for displaying identification information for the respective pocket, the labeling members being positioned to extend beyond the papers held in the overlapping pockets.

According to various exemplary embodiments, the file can have pocket panels that have second edge portions defining the openings oriented at an angle to the first edge portions, and the pocket tabs extend from the second edge portions. The second edge portions can be overlapping and substantially aligned. The plurality of pocket panels can include at least two inner pocket panels that are connected to the first cover panel only at the first connection portions, such that the outermost pocket panel retains the inner pocket panels between the outermost pocket panel and the first cover panel.

According to various exemplary embodiments, a file can be provided having first and second cover panels pivotally connected to each other at a hinge for movement between an open and closed position, the cover panels overlapping each other in the closed position to contain papers of a predetermined size therebetween. The file can have a plurality of superimposed pocket panels attached on an inside of the first cover panel to define overlapping pockets, the pocket panels arranged and dimensioned to hold the papers so that the papers in the pockets are covered by the overlapping cover panels in the closed position, wherein the pocket panels are coiled onto each other about a spine in a stack.

According to various exemplary embodiments, the file can have an attachment panel coiled about the spine and attached to the first cover panel, wherein the stacked pocket panels are also attached to the first cover panel at an opposite side from the attachment panel.

According to various exemplary embodiments, a method of constructing a multiple-pocket file can be provided, where a plurality of pocket panels can be provided that are connected to each other, and the pocket panels can be coiled around a hinge member to stack the panels about each other, such that the hinge member forms a common spine connecting the pocket panels, and stacked pocket panels can be affixed to a file cover.

According to various exemplary embodiments, the file cover can include first and second cover panels in hinged association each other for overlapping each other to provide a folder. The pocket panels can be provided as a portion of a unitary blank that includes the first and second cover panels. The coiled pockets and common spine can include a base extending from the cover, the method comprises folding the stacked pockets at the base towards the cover, and wherein another side of the spine, remote from the base, is affixed to the cover to affix the stacked panels to the cover at opposite ends thereof.

According to various exemplary embodiments, the cover can include first and second cover panels in hinged association each other for overlapping each other to provide a folder, and the base and other side of the spine are connected to the first cover panel. One of the pocket panels can include the base and is connected to the cover along a hinge to provide a closed bottom of a pocket in the constructed file. The pocket panels can include at least three pocket panels, and the coiling of the pocket panels can include rotating a first of the pocket panels about the spine one full rotation, and rotating a second of the pocket panels about the spine by half a rotation. An attachment panel can be coiled about the spine and adhered to the cover for affixing the spine thereto.

Described herein with reference to the attached figures are various exemplary embodiments according to the present invention.

BRIEF DESCRIPTION OF THE DRAWINGS

Further features and advantages of the invention will become apparent from the following detailed description taken in conjunction with the accompanying figures showing illustrative embodiments of the invention, in which.

Figure 1:
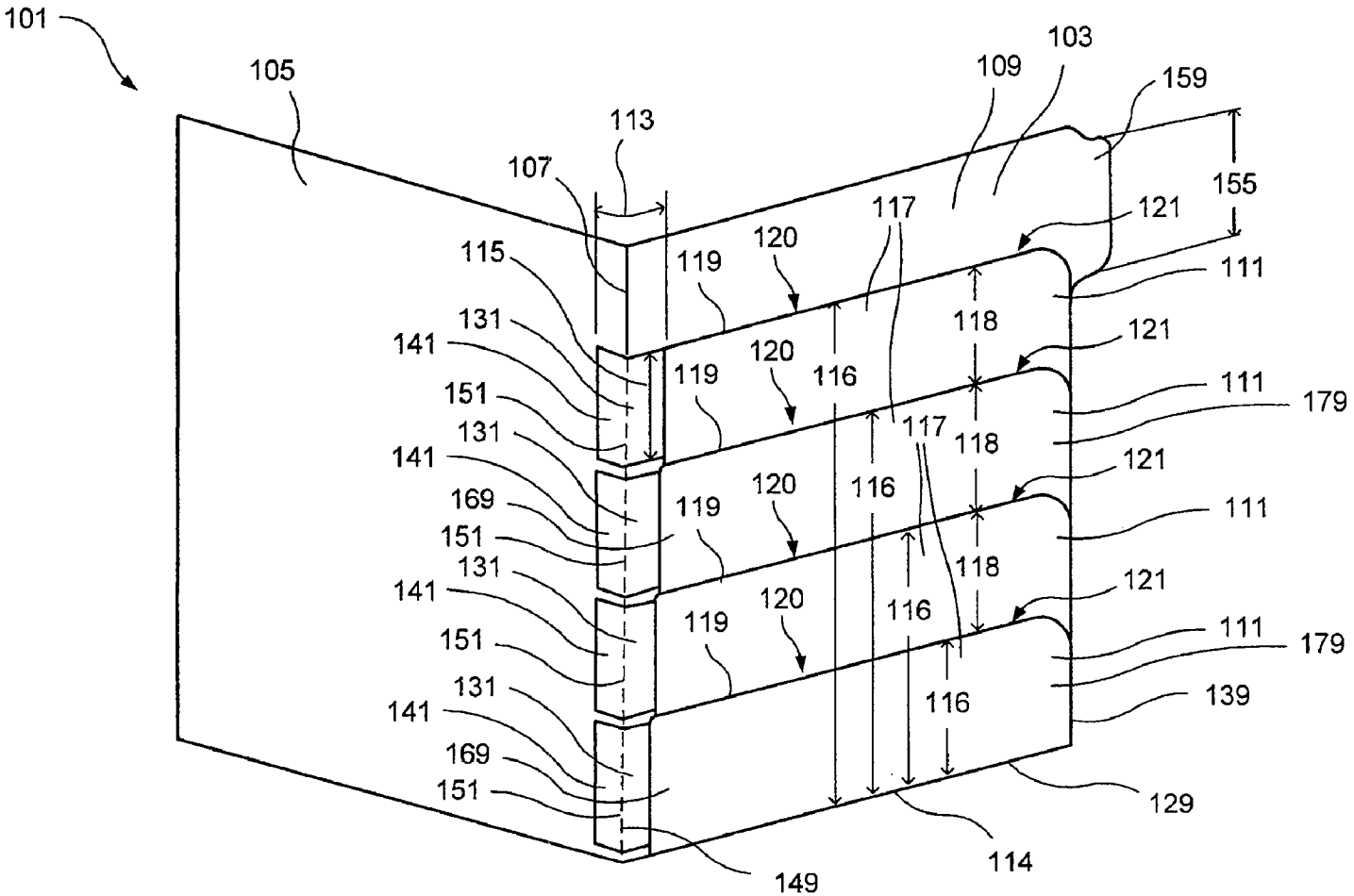
FIG. 1 is a front view of an exemplary embodiment of a file according to the present invention in an open position.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described exemplary embodiments without departing from the true scope and spirit of the subject invention as defined by the appended claims.

DETAILED DESCRIPTION OF EXEMPLARY EMBODIMENTS

FIG. 1 is a front view of an embodiment of a file according to the present invention in an open position. File 101 is shown having a first cover panel 103 and second cover panel 105 pivotally connected to each other at a hinge 107 for movement between an open and closed position. The cover panels 103, 105 can overlap each other in the closed position to contain papers of a predetermined size.

The cover panels 103,105 are preferably substantially the same size, but alternatively can be of different sizes. Preferably, both cover panels 103,105 are large enough to completely cover papers contained between the cover panels 103, 105 or in pockets in the interior of the file.

As shown in FIG. 1, a plurality of superimposed pocket panels 111 can be connected to the first cover panel 103, preferably on the inside 109 thereof, to define overlapping pockets 121. The pocket panels 111 can be connected to the cover panel, such as directly or via a common attachment flap or other portion, by adhering, fastening, or otherwise securing them to the cover panel 103. They can also be connected by folding over a portion of a blank that also forms the cover panel 103 or a part thereof to form a pocket panel 111. Each pocket 121 can be configured and dimensioned to hold the papers so that the papers are covered by the overlapping cover panels 103,105 in the closed position. The pocket panels 111 can have edges 119 that define openings 120 to the pockets 121. The edges 119 include edge portions 117 that can be staggered with respect to each other.

As seen in FIG. 1, for example, edge portions 117 are staggered in height so that pockets 121 have different depths 116 from one another. Preferably, the bottom 114 of the pockets are at the same location on the cover panel 103 so that while the pockets have different depths 116, the papers placed in the pockets can be positioned in substantially the same location with respect to the cover panel 103. Embodiments in which the pockets have substantially the same bottom 114 location can be provided with pocket panels 111 that each extend to or near the bottom 114, or pocket panels that are partially overlapped so that the bottoms of the panels are not all at the same height along the cover panels. This arrangement can still retain the stacked pocket openings and effectively provide a bottom for the pockets that is at a common location, such as by having the outermost pocket panel, overlapped over all the others, provide the closed bottom for the remaining pockets. Alternatively, two or more or all of the pocket panels can be attached to provide closed pocket bottoms. In an alternative embodiment, the pockets have different depths. Files according to the various embodiments can be configured with any suitable number of pockets 121, depending on the material used and the size of the file. For example, some embodiments can have from 2 to 10 pockets, or 4 to 8 pockets.

The distance 118 between adjacent edges 119 of the pockets in the direction of the stagger can be regular (e.g., the same) or varied. For example, the spacing, or distance 118, between the edges 119 can be, e.g., about ¼ inch, ½ inch, 1 inch, 1½ inches, 1¾ inches, 2 inches, 2½ inches, 3 inches or 4 inches. Alternatively, distance 118 can be, e.g., approximately 5%, 10%, 25%, etc. of the length of edge 139; or ⅕, ¼, ⅓, etc. of the length of edge 139, for example. Pocket panels 111 can be attached on the inside 109 of the first cover panel 103 along, and preferably near, a bottom edge 129, and can also be attached along and near outside edge 139 and/or inside edge 149, which may correspond to hinge 107, for example, or be displaced therefrom. Pocket panels 111 can be attached at two or three edges thereof, leaving one or two edge portions 117,169,179 unattached to define openings 120. In an alternative embodiment, the bottom edge portion is one of the ones that are unattached.

Also as shown in FIG. 1, file 101 can comprise a labeling member 131 associated with each pocket panel 111 and configured for displaying identification information adjacent to the respective pocket 121. The labeling members 131 can also be disposed on the second cover panel and aligned with edge 119 of the pocket panels 111 such that each labeling member 131 corresponds with a respective pocket 121.

Labeling members 131 can comprise pocket tabs 141, which can be dimensioned, configured, and positioned to extend from the pocket panels beyond the papers held in the overlapping pockets. The pocket tabs 141 preferably extend from open or more edge portions of the pocket panels 111 that define openings 120, and more preferably on a side of the open edge portion that is adjacent another open edge portion to facilitate opening the pocket by pulling on the pocket tab. In this configuration, the tabs are disposed at or between open sides of the pockets, such as at corners between adjacent edge portions. Other labeling members can be provided in association with closed edge portions.

The pocket tabs 141 illustrated in FIG. 1 are each predominantly rectangular in shape when viewed from the front or back, although alternative shapes can be used, such as trapezoidal, partially-circular and triangular, for example. Also, the pocket tabs 141 can have a width 115 in the direction of edge 149 that is about the same as distance 118. Alternatively, the width 115 can be less than distance 118, such as approximately 90%, 80%, 70%, etc., thereof. The pocket tabs 141 can be of different heights 113 from one another or be of the same height 113. For example, the heights 113 can be about 90%, 80%, 70%, etc. of the width 115.

Further as shown in FIG. 1, for example, file 101 can have a file tab 159 extending from the first cover panel 103 and/or the second cover panel 105. The file tab 159 can be of a different shape and/or size than the pocket tabs 141 or other labeling members 131. The labeling members 131, such as the pocket tabs 141, can be of different heights from one another and/or from the file tab 159 and can be disposed extending in the same direction as the file tab 159 with respect to hinge 107, for example extending away from hinge 107. In some embodiments, varied configurations and orientations of pocket tabs or other labeling members can be used to help distinguish among them. The pocket tabs 141 of this figure extend across hinge 107 and can have fold lines 151 configured so that pocket tabs 141 will fold with hinge 107 when cover panels 103,105 are in the closed position. According to some embodiments, the labeling members, such as pocket tabs, can have a portion extending to above edge 119 to above the top sections of the pockets 121, or below the edge 119 of the adjacent pocket panel 111 superimposed thereon. Preferably, the labeling members 131 are aligned with a region of the pockets 121 that is not overlapped when papers are contained therein.

In this example, covers panels 103,105 are illustrated in FIG. 1 as being predominantly rectangular in shape when viewed from the front or back. Shapes other than rectangular can be used, such as trapezoidal, partially-circular and triangular, for example. Moreover, the first cover panel 103 can be similarly or differently shaped compared to second cover panel 105.

Cover panels 103,105 can also be of about the same or different size. For example, cover panels 103,105 can be sized to be, e.g., about 5%, 10%, 25%, etc. larger than the papers to be contained between the cover panels 103,105. According to some embodiments, cover panels 103,105 can be sized to be approximately 1 inch greater in width and approximately 1 inch greater in height than the papers so as to provide for overlapping the papers by approximately ½ inch along all four edges of the cover panels 103,105. Alternatively, cover panels 103,105 can be sized to be approximately 2 inches greater in width and approximately 1 inch greater in height than the papers so as to overlap the papers by approximately 1 inch along two opposite edges and ½ inch along the other two edges. Cover panels 103,105 can alternatively be sized larger to provide for overlapping the papers by more than approximately 1 inch, for example, up to approximately 2 inches, 3 inches or more.

First cover panel 103 can include a file tab 159 which extends away from hinge 107. Alternatively, file tab 159 can be disposed to extend from the first cover panel 103 in a direction of the hinge or about parallel to the hinge. File tab 159 can be of various sizes and dimensions based on a number of factors including, e.g., the size of the file and respective covers. For example, in certain embodiments of the present invention, the file tab 159 can have a width 155 as small as 10% of the length of the file edge 139 from which the file tab 159 extends. Alternatively, the file tab 159 can have a width 155 of up to 50% of the length of the file edge 139 from which the file tab 159 extends, for example. According to various embodiments, width 155 can be as small as ½ inch or as large as 5 inches. It may be preferable to have larger file tabs for certain embodiments, especially for, e.g. when a file is configured with pockets 121 to hold sheets of paper larger than letter size (i.e. about 8.5 inches×11 inches), such as, e.g., legal size (i.e., about 8.5 inches×14 inches) or A4 size (i.e. about 20 centimeters×30 centimeters), for example. File tab 159 also can vary in height (i.e. the distance it protrudes from the edge 139). For example, the height of file tab 159 can be, e.g., about 10%, 20%, 30%, etc. of the length of file edge 129.

File tab 159, as illustrated in FIG. 1, may be, e.g., roughly trapezoidal in shape having a base width of about 2 inches, top width of about 1½ inches and a height of about ½ inch, for example. Such sized file tab 159 may preferably be used, e.g., with a file 101 dimensioned for use with letter size paper. Shapes other than trapezoidal can be used for file tab 159, such as rectangular, partially-circular and triangular, for example. Shapes that are symbolic or representative of the contents or subject of the papers that may be contained therein can also be used.

File tab 159 can be located to extend from first cover panel 103 in various locations with respect to the first cover panel 103. In addition, a plurality of file tabs 159 can be provided and disposed to extend in the same and/or different directions from one another and/or with respect to the hinge 107. For example, one or more file tabs 159 can be disposed to extend from the second cover panel 105 as an alternative or in addition to one or more file tabs 159 being disposed to extend from the front cover panel 103.

File tab 159 and pocket tabs 141 can be of similar construction, and can be made from the same sheet stock as the cover panels 103,105 and/or pocket panel 111, for example. Alternatively, file tab 159, pocket tabs 141 or other labeling members 131 can be made from separate material the cover panels 103,105 and/or pocket panel 111, and affixed thereto, respectively. Further, file tab 159 and pocket tabs 141 can be configured to be marked upon, to be written upon, to receive a label, or otherwise configured for adaptation to a user's needs.

Figure 2:
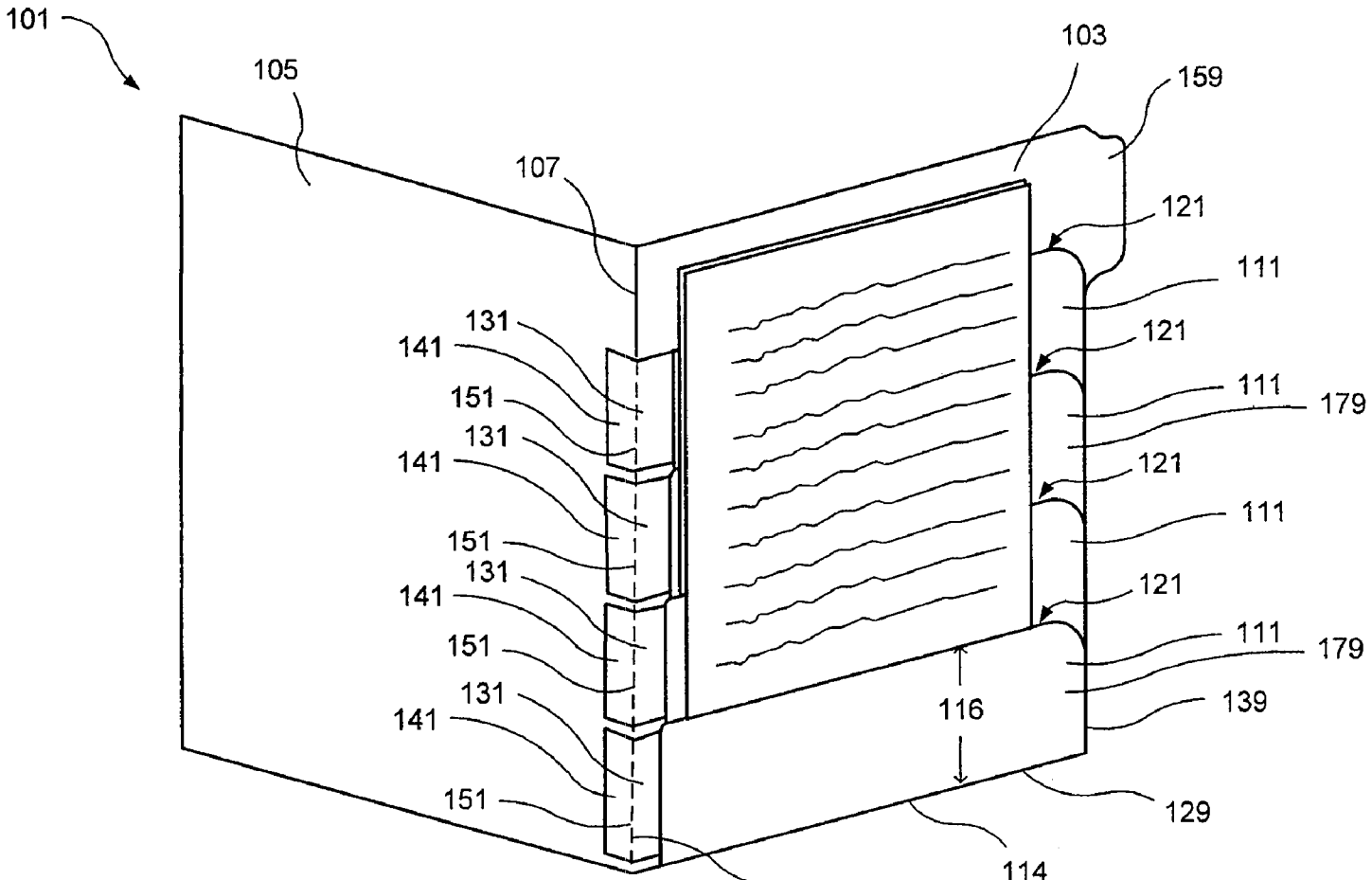
FIG. 2 is a front view thereof holding papers in the pockets.

FIG. 2 is a front view of the exemplary embodiment of a file of FIG. 1 showing paper 201 being held within the pockets 121. Pockets 121 can be configured and/or dimensioned for holding various sized paper 201. Pockets 121 can be configured and dimensioned for holding a stack of paper with a thickness of at least about ⅛ inch to 1 inch. Some of the pockets 121 also can be configured and dimensioned for holding a stack of paper with a different size or thickness from other pockets 121. Although preferably at least one or two of the pockets 121 are configured and dimensioned to hold papers of the same size corresponding to the file size, in the example shown in FIG. 2, all of the pockets 121 are sized to hold the same size papers corresponding to the file size and cover panel 103.

Figure 3:
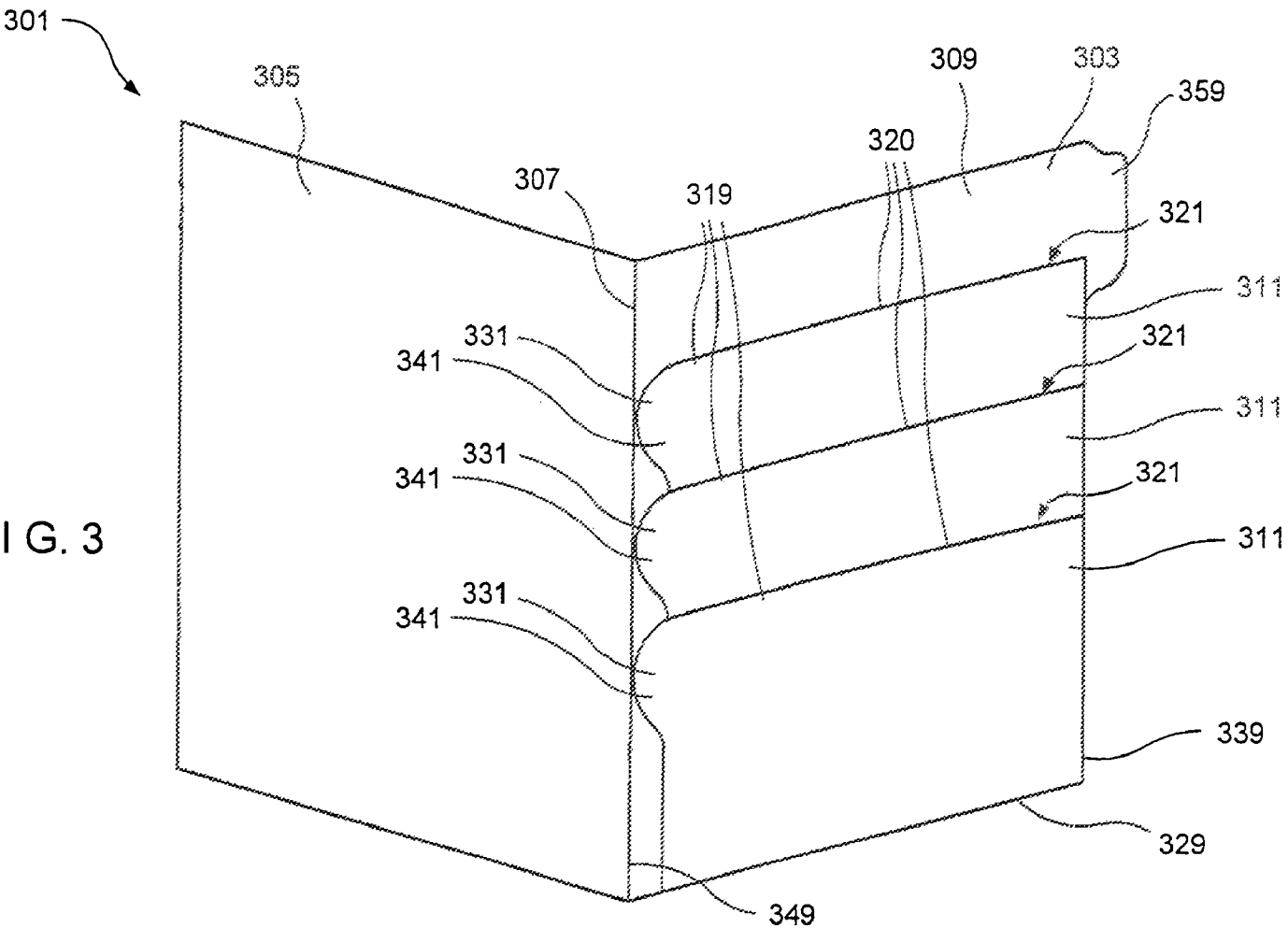
FIG. 3 is a front view of another exemplary embodiment of a file according to the present invention in an open position with only three pockets disposed on the front cover panel.

FIG. 3 is a front view of another exemplary embodiment of a file according to the present invention in an open position. This embodiment has three pockets 321 disposed on front cover panel 303. Pocket tabs 341 extend from pocket panels 311 in a direction towards the hinge 307. In this example, pocket tabs 341 do not extend all the way to, or past, the hinge 307.

Figure 4:
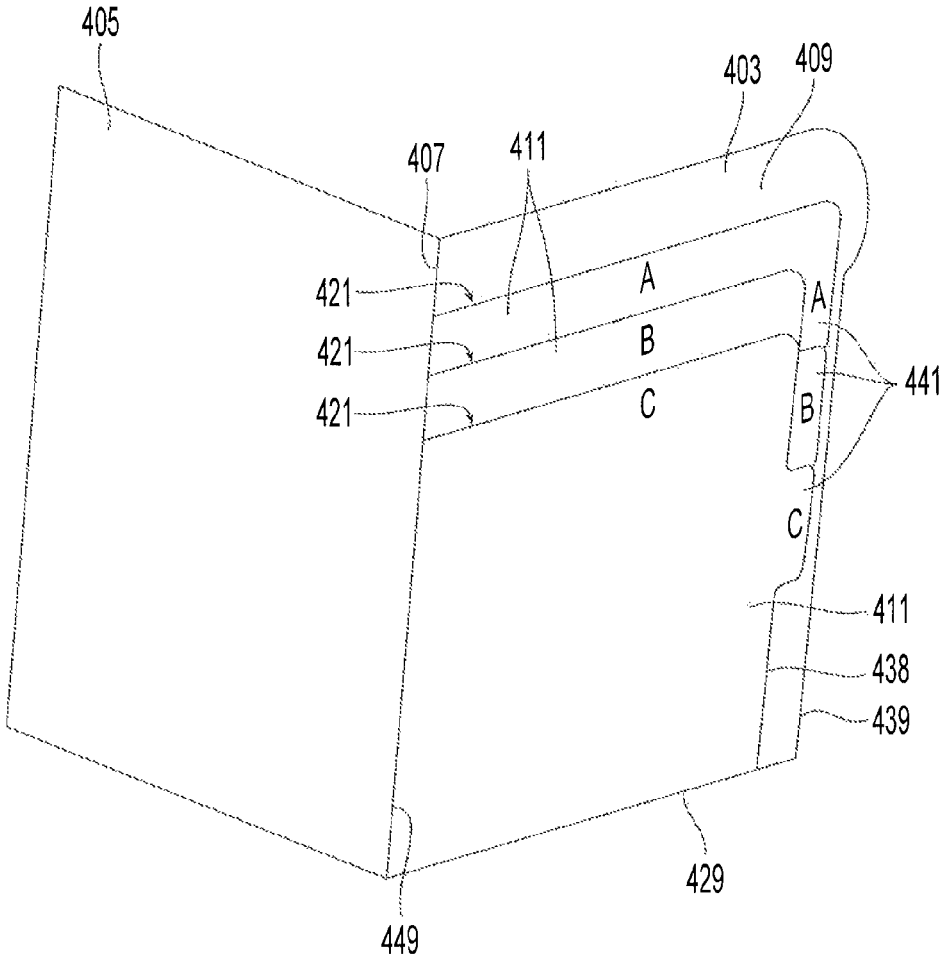
FIG. 4 is a front view of another exemplary embodiment of a file according to the present invention in an open position with labeling members extending from the pocket panels in a direction away from the hinge.

FIG. 4 is a front view of another exemplary embodiment of a file according to the present invention in an open position. As illustrated in FIG. 4, pocket tabs 441 extend from pocket panels 411, past the edge 438 of the pocket panels that is disposed distally from the hinge 407, in a direction away from the hinge 407 towards edge 439. In this example, pocket tabs 441 do not extend all the way to edge 439. In various other embodiments, labeling members, such as tabs 441, can extend to near edge 439 or, alternatively, beyond edge 439 so as to protrude from the cover panel 403. As also shown in FIG. 4, pocket tabs 441 are disposed to extend from the pocket panels 411 so as to be visible when papers are contained in the pockets 421. Pocket tabs 441 also are staggered from each other so as to not cover each other and be visible when looking at the inside 409 of the cover panel 403 when the cover panels 403,405 are in an open position.

Except for the pocket tab 441 labeled as "A", the other pocket tabs 441 are out of alignment with the top edge portions, and in the case of the pocket tab 441 labeled "B", it is out of alignment with the area of its respective pocket panel that is exposed from the overlapping pocket panels 411 labeled "C". Preferably, the pocket panels 411 and pocket tabs 441 or other labeling members have a visual indicator that they correspond to each other, such as by color or pattern coding, or by symbols that appear both at the exposed portion of the pocket panels and the labeling member. As illustrated in FIG. 4, the same symbol can be displayed near the top of each pocket panel 411 and on the pocket panel's corresponding labeling member 441 for clarity as to the association of the labeling members 441 with respect to the pockets 421 to which they correspond. In other embodiments, no visual link is provided between the offset pocket tabs and the exposed portions of the pocket panels.

In this example, pocket panels 411 are attached at edges 429,449, leaving the other two edges unattached to define openings 420. The pocket tabs 441 are preferably associated with open of the unattached edge portions so that selected pockets can be opened by lifting the appropriate pocket tab 441.

Figure 5:
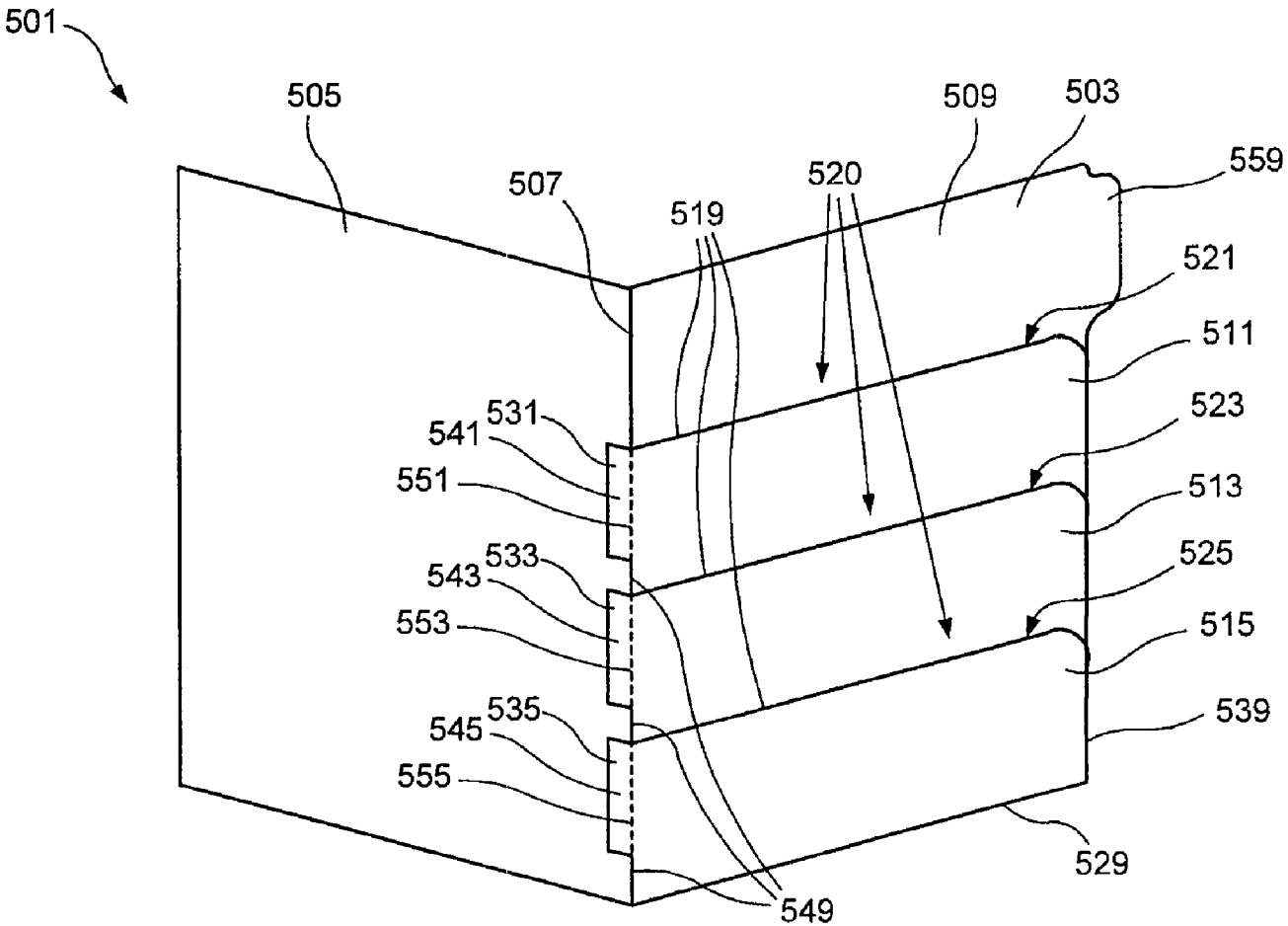
FIG. 5 is a front view of yet another exemplary embodiment of a file according to the present invention in an open position, in which the pocket panels are attached at an edge of the pocket panels to the front cover panel at the hinge.

FIG. 5 is a front view of yet another exemplary embodiment of a file according to the present invention in an open position. The exemplary embodiment illustrated in FIG. 5 is similar to the exemplary embodiments illustrated in FIGS. 3 and 4, although as shown in FIG. 5, the pocket panels 511 are attached at edge 549 to the first cover panel 503 at the hinge 507. Pocket tabs 541 are disposed on corresponding pocket panels 511 and extend from pocket panels 511 over cover panel 505, respectively.

Figure 6:
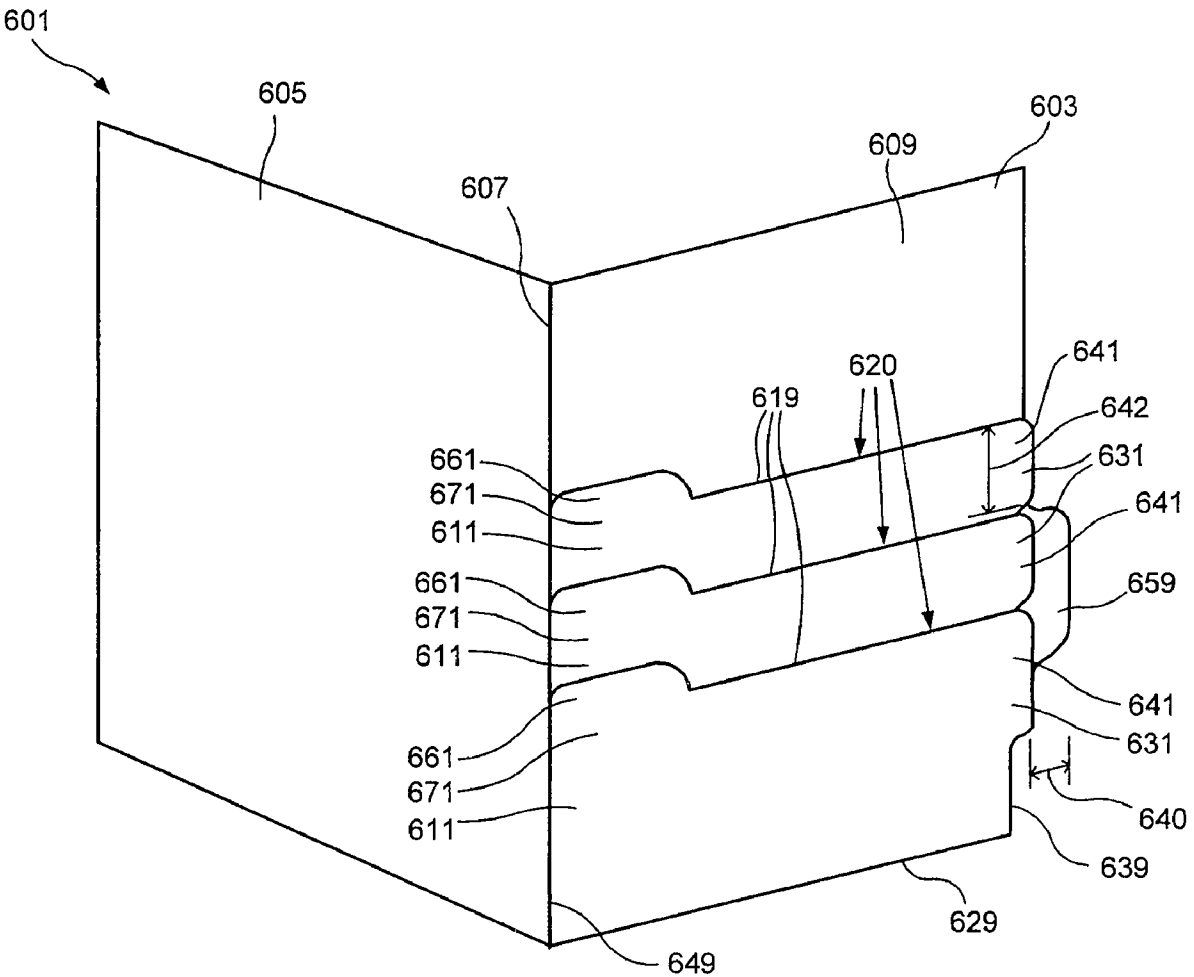
FIG. 6 is a front view of still another exemplary embodiment of a file according to the present invention in an open position, with pocket tabs that extend from the pocket panels in a direction away from the hinge beyond an edge of the file.

The embodiment illustrated in FIG. 6 has labeling members 631 that comprise pocket tabs 641 that extend from pocket panels 611 in a direction away from the hinge 607 beyond the file edge 639. As illustrated, the pocket tabs 641 are staggered from one another and from the file tab 659 so that all of the pocket tabs 641 and the file tab 659 can be visible as protruding from the file edge 639 when the file covers 603,605 are in the closed position. Also, the pocket tabs 641 are sloped differently from the file tab 659, to provide for easy visual distinction therefrom. Furthermore, file tab 659 can protrude a height 640 above pocket tabs 641 so as to further provide for easy visual distinction therefrom. Pocket tabs 641 have a width 642 that can be the same for all the pocket tabs 641 or vary between. The width 642 can be sized according to the distance of the spacing between adjacent pocket panel edges 619. For example, as shown in FIG. 6, the width 642 can be approximately 90% of the distance between adjacent edges 619. Alternatively, the width 619 can be greater than the distance between adjacent edges 619 when relatively larger and/or overlapping pocket tabs 641 may be preferred. The width 642 alternatively can be smaller than 90% of the distance between adjacent edges 642, such as, e.g., 80%, 70%, 60% or smaller, although between 80% and 90% may be preferable according to certain embodiments.

As shown in this example, in some embodiments, there can be second labeling members 661 that can comprise pocket tabs 662 that extend from a different edge portion of the pocket panels 611 and in a different direction than the other labeling members 631. Various embodiments can have additional labeling members extending or disposed adjacent or from other or the same edge portions.

Figure 7:
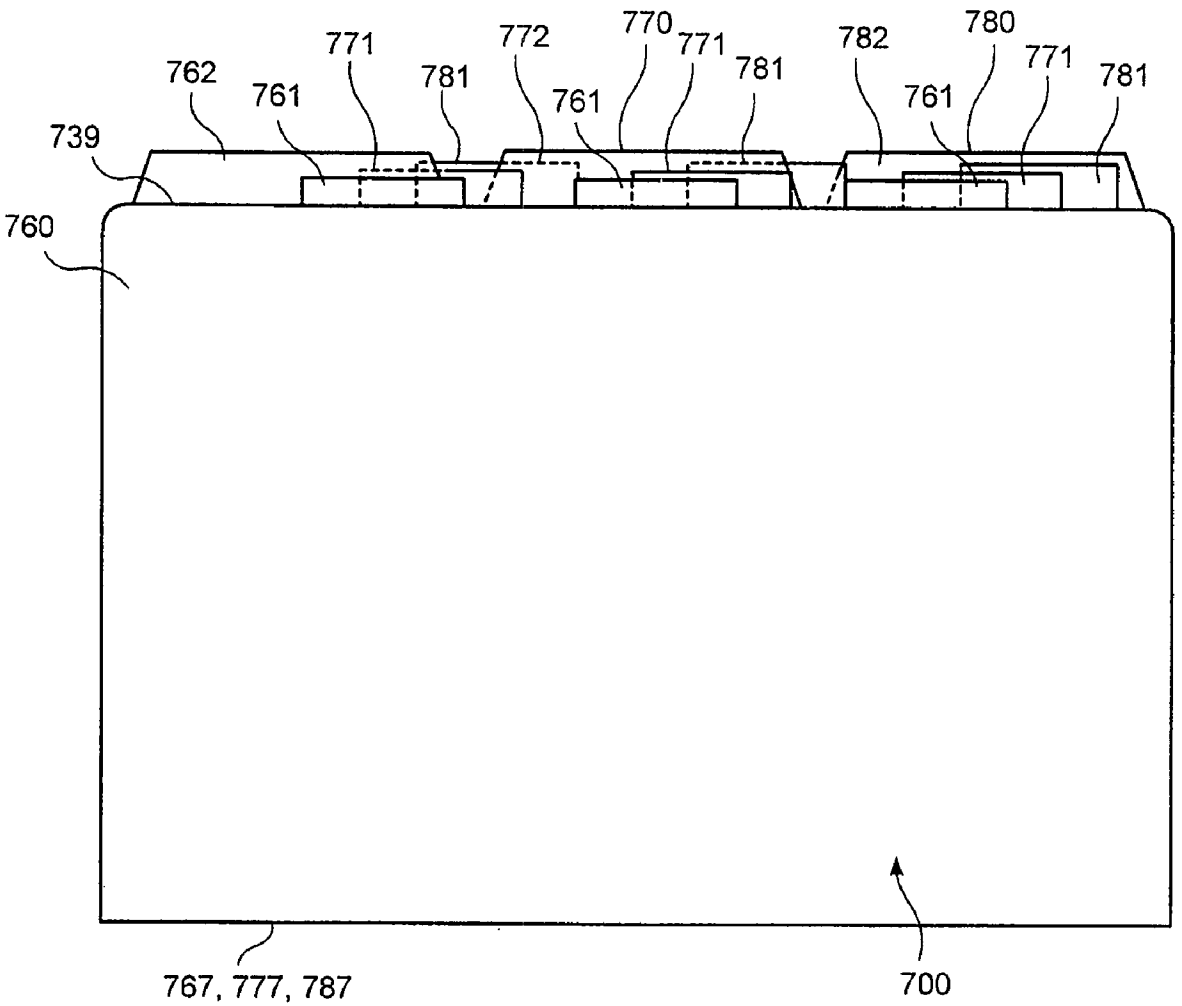
FIG. 7 is a front view of an exemplary embodiment of a filing system according to the present invention with a group of files in a closed position disposed one in front of another.

Referring to FIG. 7, filing system 700 can have a group of files 760,770,780 which are disposed one in front of another. The files 760,770,780 have file tabs 762,772,782, respectively, protruding beyond file edge 739 so that the file tabs are staggered with respect to each other when the files are aligned. For example, the file 760 has file tab 762 protruding beyond file edge 739, which are staggered with respect to each other so as to be at least partially visible when the files 760,770,780 are disposed one in front of another in alignment and viewed from the front.

The exemplary embodiment shown in FIG. 7 provides for a user to not only be able to identify a particular file 760,770,780 from a group of files in the filing system 700 that may be desired based on information displayed on the file tabs 762,772,782, but also can enable a user to identify certain particular pockets within a file corresponding to one of pocket tabs 761,771,781 that may be of interest based on information displayed on the pocket tabs 761,771,781.

Figure 8:
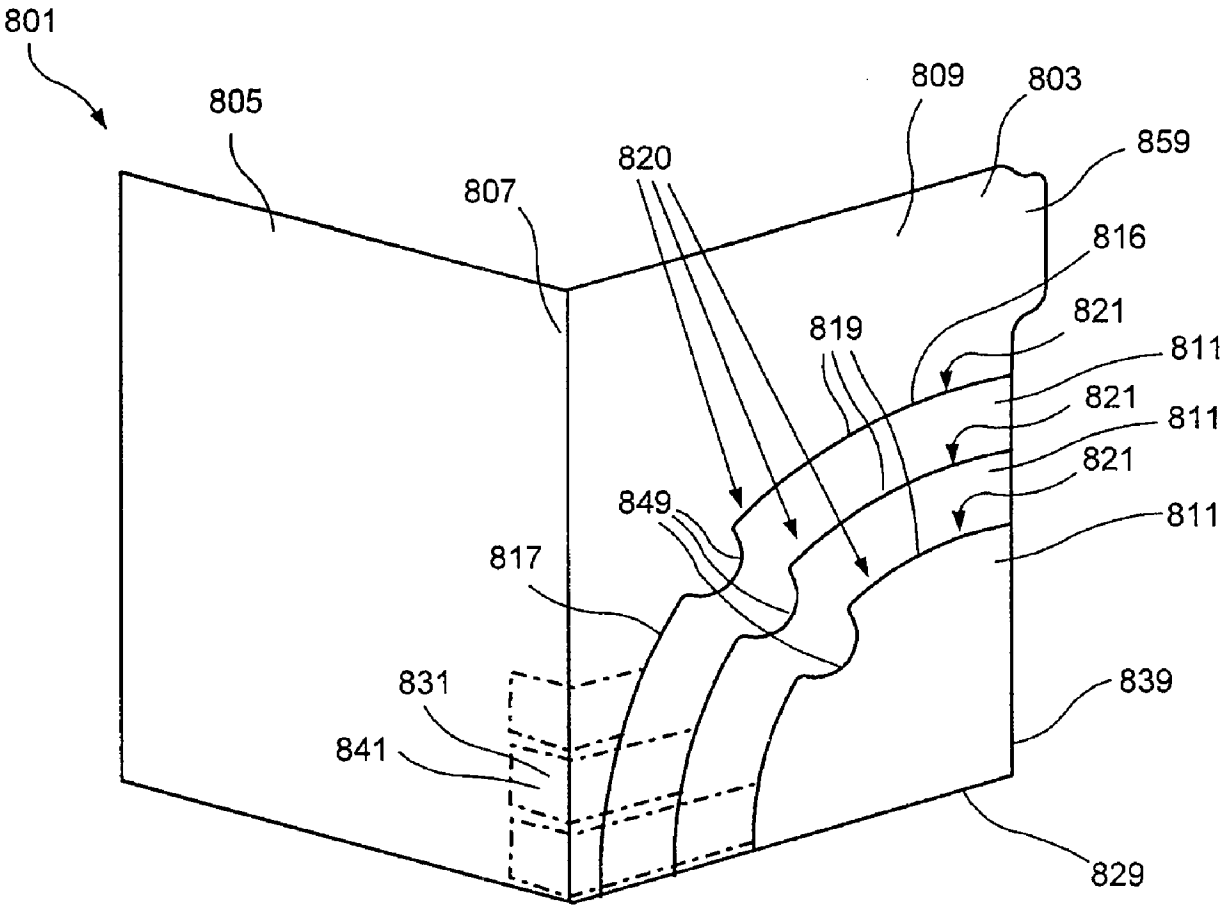
FIG. 8 is a front view of another exemplary embodiment of a file according to the present invention in an open position in which the pocket panels are rounded without a corner between the top and inner edge portions and notches are defined in the edges of the pocket panels.

FIG. 8 is a front view of another exemplary embodiment of a file according to the present invention in an open position. The pocket panels 811 of this embodiment are rounded without a specific corner between the top and inner edge portions 816, 817. Pocket panels 811 have closed edges attached near or at 829,839 of cover panel 803. The curved edges 819 define openings 820 to the pockets 821. Furthermore, edges of each pocket panel 811 define notches 849 that are configured and dimensioned to receive a user's finger, such as a thumb or index finger, to enable the user to grip and lift the pocket panels 811 to open the pockets 821. In this embodiment, optional pocket tabs 841, which are shown in phantom lines, can extend from the pocket panels 811 in a direction towards the hinge 807.

Figure 9:
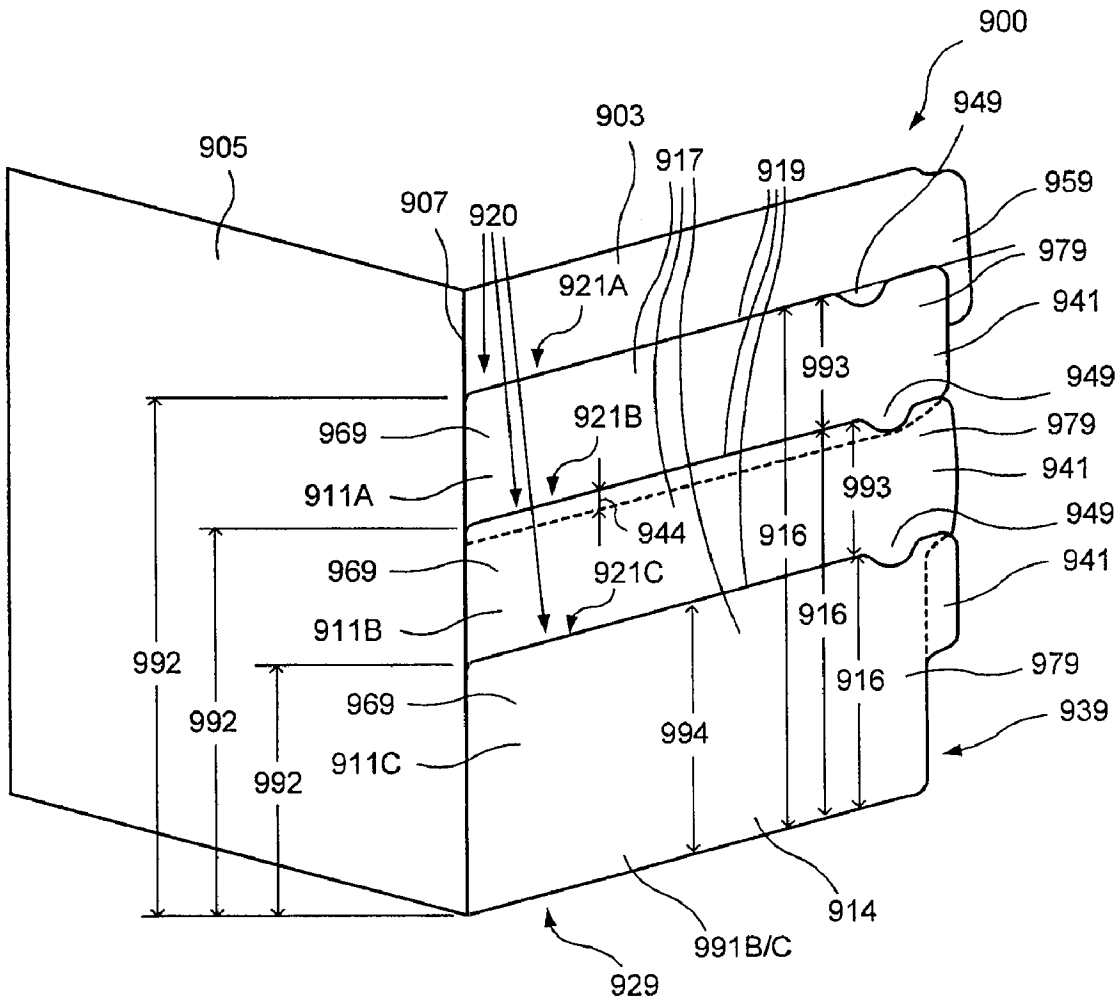
FIG. 9 is a front view of another exemplary embodiment of a file according to the present invention.

Referring to the embodiment of FIG. 9, which is shown in an open position, file 900 can include a first cover panel 903, a second cover panel 905, and a file tab 959. The file 900 may also include a plurality of pocket panels 911, pocket tabs 941, and notches 949.

As shown, the first cover panel 903 can be attached to the second cover panel at a hinge 907. Additionally, the file tab 959 can be attached to and/or extend from the first cover panel 903. The first cover panel 903, the second cover panel 905, and the file tab 959 may be the same or similar to one or a plurality of the embodiments previously described and may be a combination of any and/or all of these embodiments.

Figure 11:
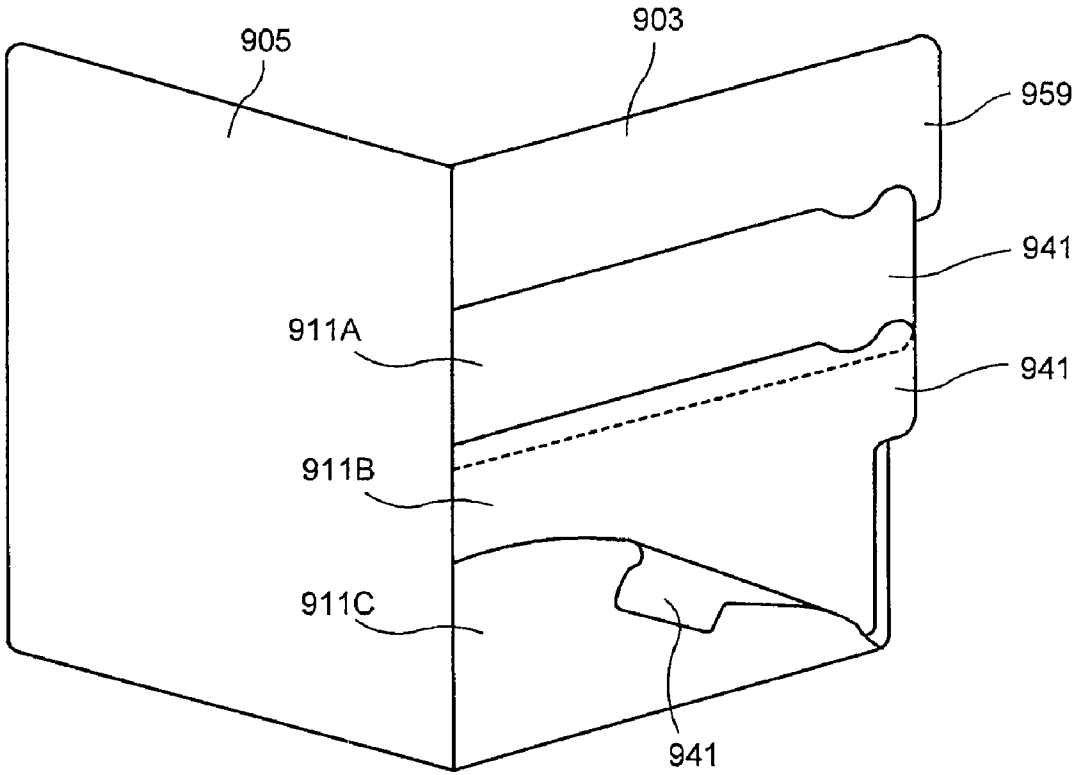
FIG. 11 is a front view of the embodiment shown in FIG. 9, with an outermost pocket panel pulled partially open.

The pocket panels 911 of the file 900 are substantially rectangular in the embodiment shown and extend from the hinge 907 to or near to the folder edge 939. Upper edges 919 of the pocket panels 911 define openings 920 to the pockets 921, and the edges 919 can include edge portions 917 that can be staggered with respect to each other. The pocket panels 911 can also have lower edges 991. The pocket panels 911 can be connected to the cover panel 903, 905 at one or more edges thereof, leaving one or more edge portions 917, 969, 979 unattached to define openings. In some embodiments, as shown in FIGS. 9 and 11, the file 900 can include at least two inner pocket panels 911A, 911B, and an outer pocket panel 911C. In other embodiments, any number of inner pocket panels can be provided.

The pockets 921 may have a bottom 914 defined by the location at which an article placed within the pocket 921 would be supported. In some embodiments, this may occur where the lower edge 991 of a respective pocket panel 911 is attached to a respective cover panel 903, 905. That is, when an article is placed behind the pocket panel 911, its downward motion will be arrested when it encounters the lower edge 991 attached to the cover panel 903, 905. In other embodiments, the lower edge 991 of a pocket panel 911 can be free from the cover panels 903, 905 as shown in FIG. 9. As such, the lower edge 991 may be a free edge. In these embodiments, the bottom 914 of pocket 921A, for example, may be where an article placed behind the pocket panel 911A would first encounter a lower edge 991 attached to a cover panel 903, 905. In this case, the article would first encounter lower edge 991C. Accordingly, the pockets 921 may each have a depth 916 defined by the distance between the upper edge 919 and the respective pocket bottom 914.

The upper edges 919 may vary in their respective distances 992 from the bottom edge 929 creating staggered edge portions 917. In one embodiment, as shown in FIG. 9, the pockets 921 share the same bottom 914 and therefore each have different depths 916 due to the varying distances 992 to the upper edges 919. Additionally, the lower edges 991 of the pocket panels 911 are such that the pocket panels 911 overlap. That is, the width of a pocket panel 911 is such that it is at least somewhat greater than the distance 993 between adjacent upper edges 919, thereby defining an overlap distance 994. As such, any given underlying pocket panel 911, for example 911A, may have a lower edge 991A falling behind the upper edge 919B of the adjacent overlying pocket panel 911B. The overlap 994 may vary as shown in FIG. 9 where the overlap 994 between pocket panels 911A and 911B is relatively small, while the overlap 994 between pocket panels 911B and 911C is relatively large. This large overlap may be seen more clearly in FIG. 11 where the lower edge 991B of pocket panel 911B is shown to overlap substantially with panel 911C.

Figure 10:
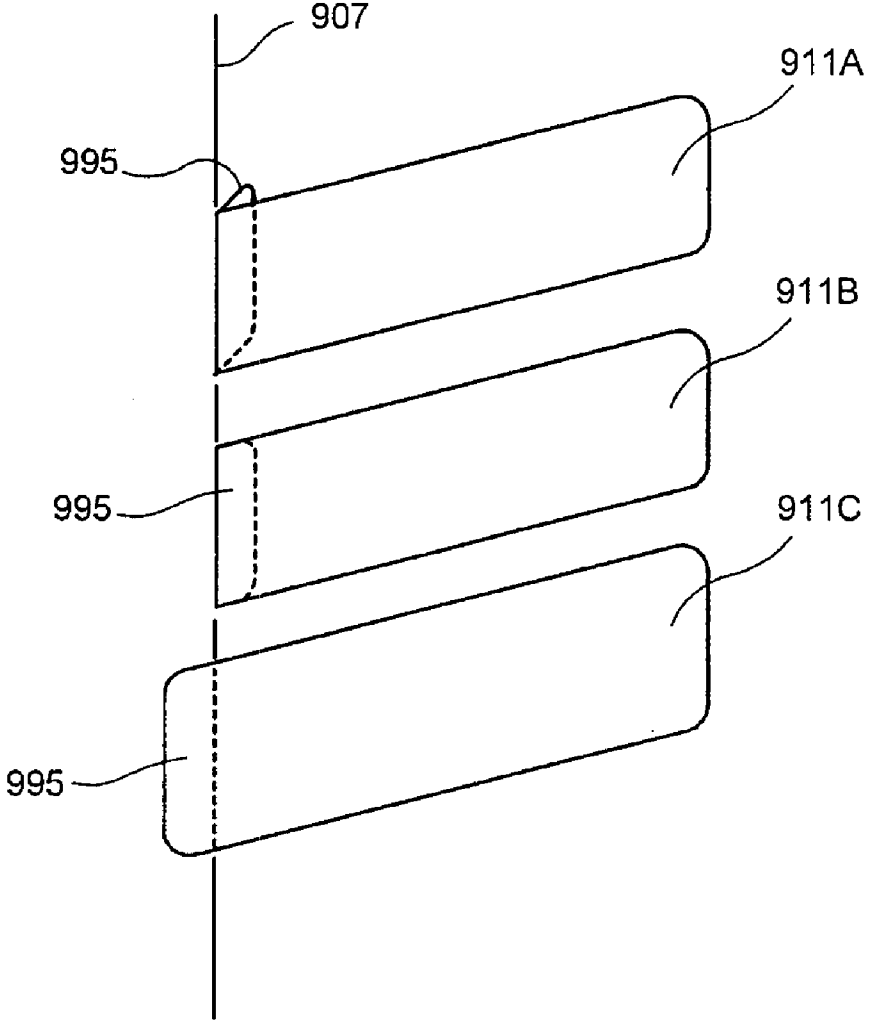
FIG. 10 is a front view of several types of attachment of pocket panels according to certain embodiments.

The edge portion 969 of the pocket panels 911 may be attached to the cover panel 903, 905 at or near the hinge 907 as shown. The attachment may be a direct connection to the cover panel 903, 905 or an indirect connection thereto, such as via attachment to another pocket panel 911 that is attached to the cover panel 903, 905. In one embodiment, the pocket panels 911 may be folded over and adhered with a coupling portion 995 as shown with respect to pocket panel 911A in FIG. 10. In another embodiment, the pocket panels 911 may be adhered with a coupling portion 995, but not folded over, as shown with respect to pocket panel 911B in FIG. 10. In still other embodiments, the pocket panel 911 may extend across the hinge 907 and be adhered with a coupling portion 995 as shown with respect to pocket panel 911C in FIG. 10.

With regard to the outermost pocket panel 911, for example 911C, the pocket panel 911C may be attached to the cover panel 903, 905 as shown by the pulled open pocket panel 911C in FIG. 11. The pocket panel 911C may be attached in a hinged relationship including a fold line where pocket panel 911C and cover panel 903, 905 are formed from the same piece of material. For example, as shown, the lower edge 919C is continuous with the cover panel 903, 905. Alternatively or additionally, the pocket panel 911C may be adhered to the cover panel 903, 905.

As shown, the pocket tabs 941 may be substantially rectangular and may have an upper edge substantially in alignment with the upper edge 919 of their respective pocket panels 911. The pocket tabs 941 may be positioned along the side of the pocket panels 911 and may extend beyond the side edge 939 of the cover panel 903, 905.

Additionally, the pocket panels 911 can have a notch 949 along their upper edge portion 917. The notch 949 may be located as shown in FIG. 9, close to the tab and close to a corner of the pocket between two open sides thereof, or may be located elsewhere along the upper edge portion 917. In an alternative embodiment, the notch 949 can be located along the side edge of the pocket panel 911. The notch 949 may be any size or shape. In one embodiment, the notch is shaped and sized to accommodate a human finger or thumb. The notch may have a radius shape with a depth and width adapted to be grasped by a finger or thumb. In one embodiment, the notch 949 may have a width of approximately ¾" and a depth of approximately ¼".

In use, a user may place articles (e.g., paper, brochures, references, and the like) behind one or more of the plurality of pocket panels 911. The file tab 959 may be labeled to indicate the nature of the contents of the file 900. The pocket tabs 941 may be labeled to indicate the nature of the contents behind a particular pocket panel 911. The file 900 may be filed and the file tab 959 may be used to locate and retrieve the file 900. The pocket tabs 941 may be used to quickly access the contents behind a particular pocket panel 911. The pocket tabs 941 may extend beyond the side edge 939 of the file 900 and as such may remain visible for this quick accessibility. A user may grasp a given pocket tab 941 and pull up on the tab 941 to lift the pocket panel 911 and expose the contents behind that panel 911. It is noted here that the overlap 994 may cause pocket panels 911 positioned outward from the pocket panel 911 being grasped to lift away as well. Additionally, the user may engage the notch 949 with one or a plurality of fingers. In one embodiment, the user may engage the notch 949 with their thumb, thereby freeing up their remaining fingers for leafing or looking through the contents in the file.

Figure 12:
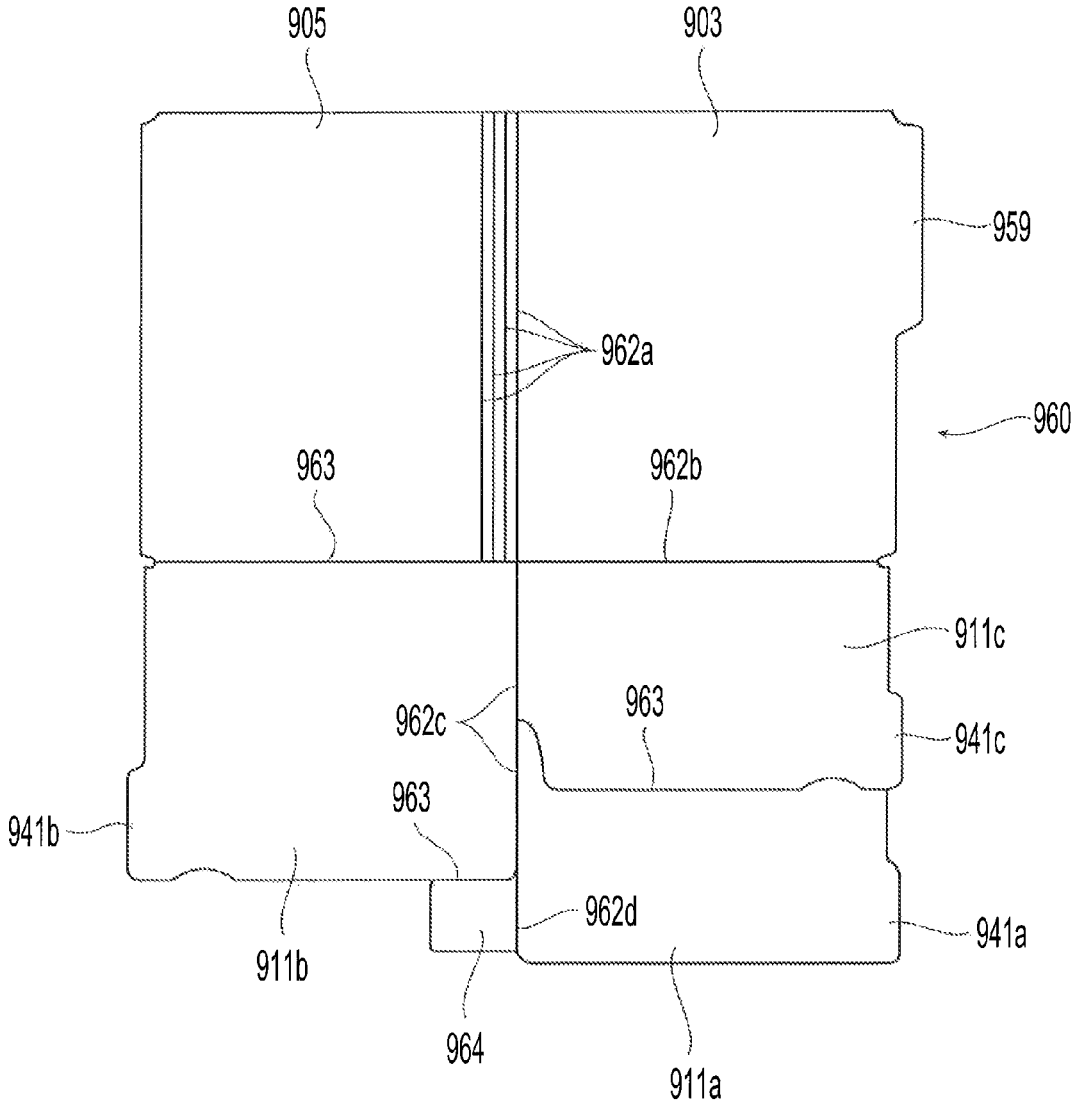
FIGS. 12-17 are front views of an embodiment of a blank used to make an embodiment of a folder.

FIG. 12 shows a blank 960 for use in manufacturing and embodiment of a multiple-pocket folder. The blank can be made of a unitary panel, which can comprise a paper or plastic material, or any other material which can be used to form a file or similar device. The portions of the blank corresponding to the different portions of the finished file are numbered using the same numerals as in FIG. 11. The blank can be provided with score lines 962A, 962B, 962C, 962D to provide hingable portions, and cut portions 963 to separate different parts of the final folder from each other. Score lines 962A can provide a hinge for the finished file. Score lines 962B-D allow parts of the blank to be folded to provide closed portions of the pockets. Pocket panels 911A, 911B, 911C can have pocket tabs 941A, 941B, 941C, respectively. A glue tab 964 can also be provided, which can be provided along a border of pocket panels 911A, 911B.

The folds made to the blank 960 in the preferred embodiment of assembling the folder are described herein are with respect to the applicable drawings. Indications of folds in the upward or downward direction are dependent on the position of the blank. Alternative ways of folding the blank 960 will become apparent.

Figure 13:
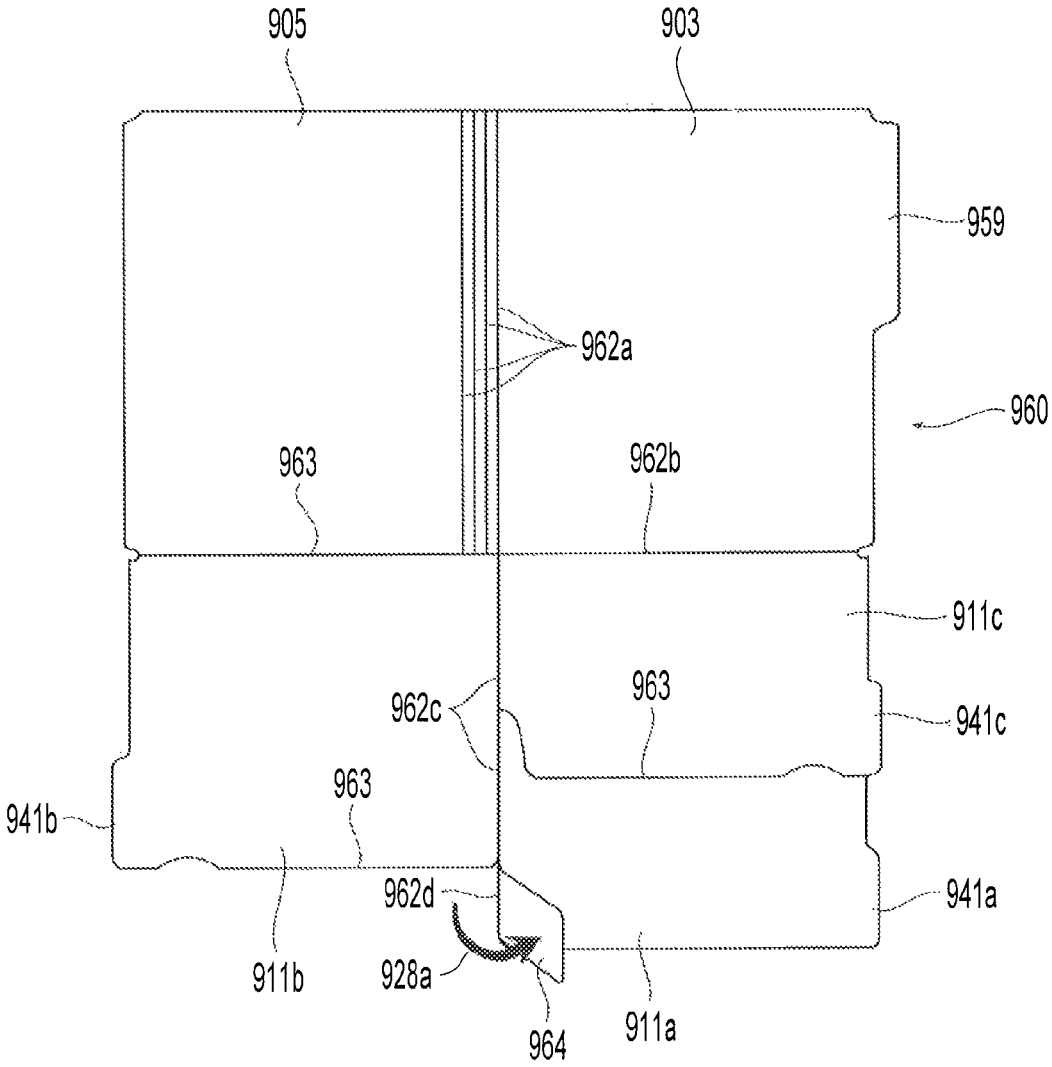
Figure 14:
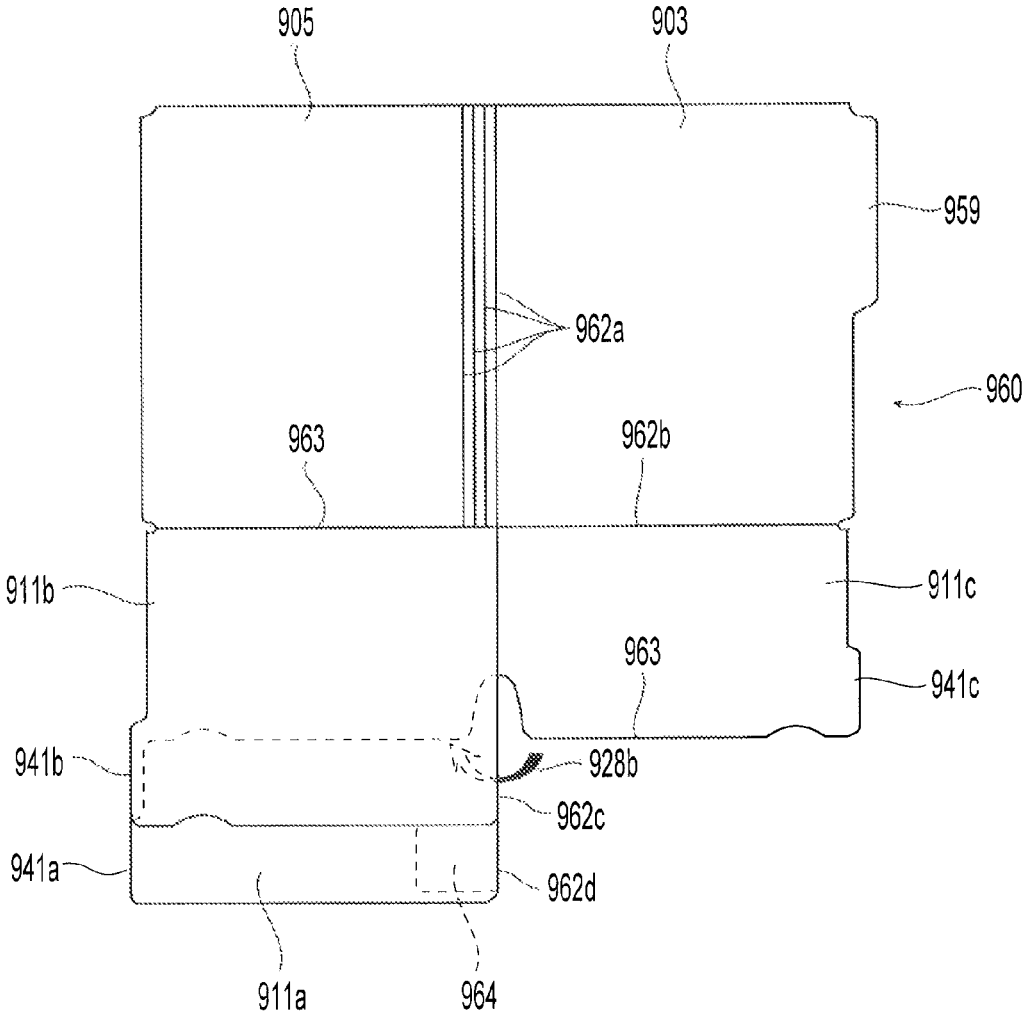

As shown in FIG. 13, glue tab 964 can be folded upwards over score line 962D in a direction indicated by arrow 928A over surface 913A of pocket panel 911A. The back surface 964A of the glue tab 964 can have an adhesive on at least a portion of or all of its surface, or this adhesive can be applied before assembly or during assembly of the file. As shown in FIG. 14, pocket panel 911A, along with glue tab 964, are then folder downwards, under score line 962C in a direction indicated by arrow 928B under surface 913B of pocket panel 911B. In this embodiment, surface 915A, on an opposite side of panel 911A, can be placed against surface 913B on the far side of panel 911B, which is on an opposite side of panel 911B from surface 915B.

Figure 15:
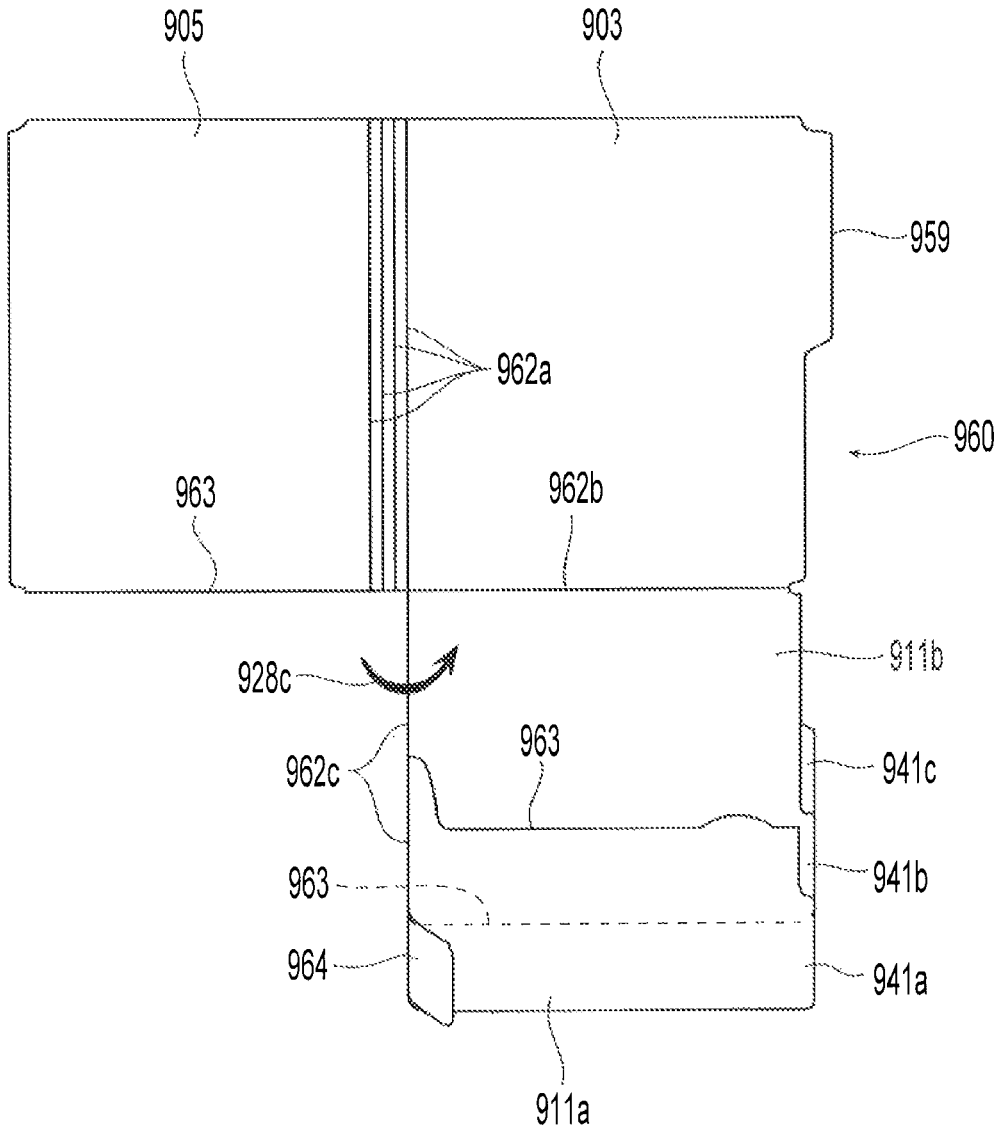

As shown in FIG. 15, pocket panel 911B, along with pocket panel 911A and glue tab 964, are then folder upwards over score line 962C in a direction indicated by arrow 928C over surface 913C of pocket panel 911C. As seen in FIG. 15, pocket panel 911B can have a larger surface area than pocket panel 911C, such that pocket panel 911B covers the surface of pocket panel 911C when it is folder over, for example such that it is not visible on a top view as shown in FIG. 15 except for its tab 941C, although in alternative embodiments, pocket panels with different relative sizes can be used. The adhesive surface 964A of glue tab 964 is visible.

As seen in this preferred method, when the pocket panels are assembled from the blank by rotating them around score line 962C, which acts as a hinge, in a same direction. The pocket panels are rotated against each other clockwise when viewed from the free end of the score line 962C. Once the pocket panels are thus coiled around the score line, they are connected to each other by a spine formed by the material about the score line. Alternative methods for assembling the stacked pockets can also be used.

Figure 16:
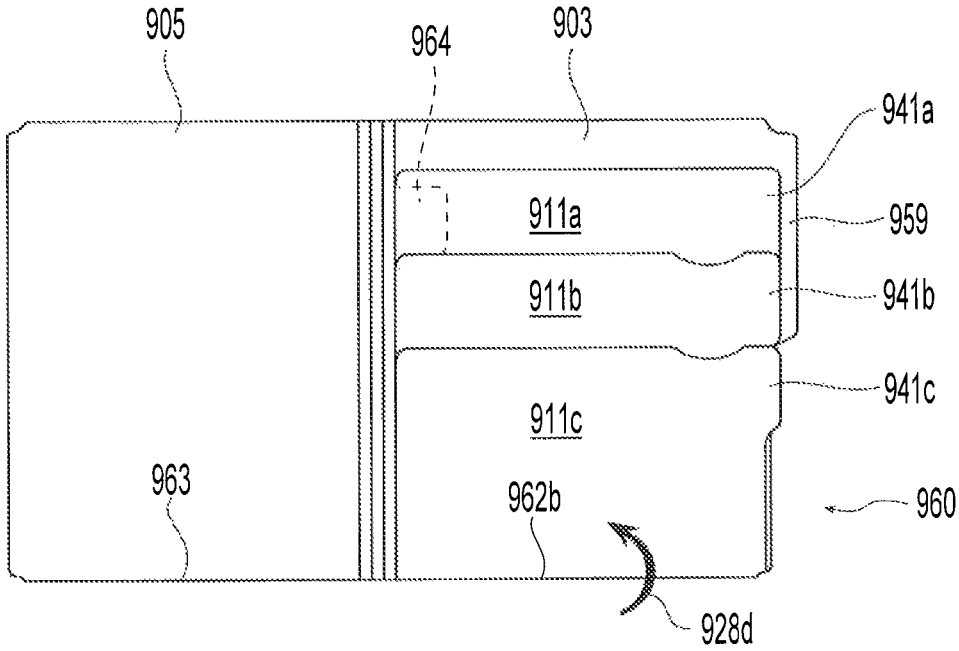
Figure 17:
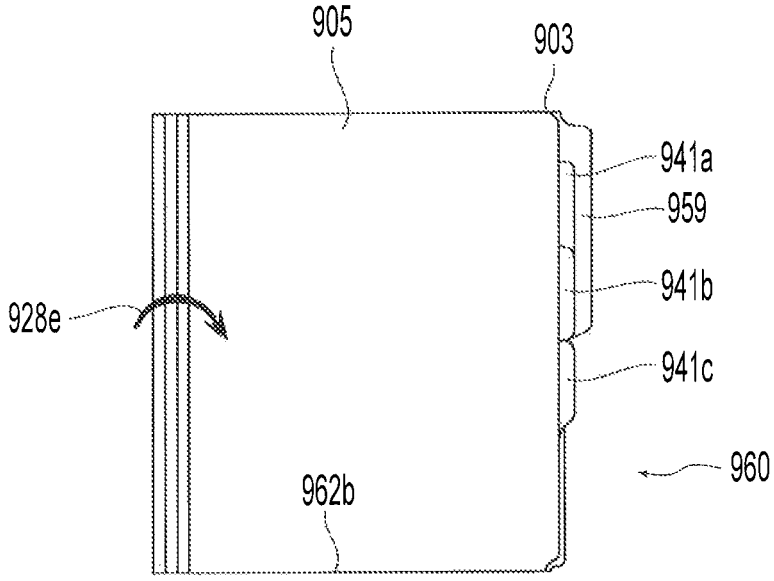

Then, as shown in FIG. 16, pocket panel 911C is folded upwards over score line 962B in a direction indicated by arrow 928D over an inner surface 903A of cover panel 903. The adhesive surface 964A of glue tab 964 affixes the tab, and the stack of pockets, to the inner surface 903A of cover panel 903, such that pocket panels 911A, 911B and 911C are attached to cover panel 903. Such arrangement provides for stacked pocket panels as shown in FIG. 16, with fold line 962B forming a closed bottom of the three stacked pockets since panel 911C is connected to the cover panel 903 and sandwiches the other pocket panels 911A and 911B therebetween. The spine provides a second closed, lateral side to the pockets. The bottom of the stacked pockets and spine, at line 962B forms a base of the coiled pocket structure. Cover panel 905 can be folded over one or more of score lines 962A along a direction indicated by arrow 928E to provide a closed file, in which file tab 959, and preferably also pocket tabs 941A, 941B and 941C, are visible.

One having ordinary skill in the art should appreciate that there are numerous sizes and shapes of paper for which there can be a need or desire to retain in a file or filing system according to an exemplary embodiment of the present invention; including a number of standard sizes of paper. Additionally, one having ordinary skill in the art will appreciate that although the preferred embodiments illustrated herein are of a bi-fold type of file without any additional flaps that would help retain the papers, additional panels and/or retaining elements can be added, and the file can be configured as, e.g., a tri-fold, quad-fold, or other type of file.

As used herein, the terms "top," "bottom," and/or other terms indicative of direction are used herein for convenience and to depict relational positions and/or directions between the parts of the embodiments. It will be appreciated that the embodiments disclosed can also be oriented in other positions.

In addition, the term "about" should generally be understood to refer to both the corresponding number and a range of numbers. In addition, all numerical ranges herein should be understood to include each whole integer within the range. While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A file, comprising:

first and second cover panels pivotally connected to each other at a hinge for movement between an open and closed position, the cover panels oveflapping each other in the closed position to contain papers of a predetermined size therebetween;

a plurality of superimposed pocket panels disposed on an inside of the first cover panel to define overlapping pockets, the pocket panels arranged and dimensioned to hold the papers so that the papers in the pockets are covered by the overlapping cover panels in the closed position, wherein the pocket panels have first and second edge portions that define openings to the pockets, the first edge portions being staggered with respect to one another, and second edge portion being disposed on a distal side of the pockets from the hinge, each pocket panel having a first connected portion that is connected to provide a first closed side of the respective pocket, and the plurality of pocket panels including an outermost pocket panel with a second connected portion connected to the cover panel to form a second closed side of at least one of the pockets; and a pocket tab disposed in association with each pocket panel and configured for displaying identification information adjacent the respective pocket, the pocket tabs extending beyond the second edge portions in a direction away from the hinge.

2. The file of claim 1, wherein the pocket tabs extend from the pocket panels, and wherein the pocket tabs are staggered from each other such that each of the pocket tabs is visible with the pockets closed.

3. The file of claim 2, further comprising a file tab extending from at least one of the cover panels, wherein the pocket tabs are a different shape or size than the file tab to provide a visual distinction therefrom.

4. The file of claim 2, further comprising a file tab extending from at least one of the cover panels, wherein the file tab and pocket tabs extend in a same direction from the hinge, the file tab extending further from the hinge than the pocket tabs.

5. The file of claim 1, wherein the pocket panels each define a notch configured and dimensioned for receiving a finger to facilitate lifting each pocket panel to open the pocket defined thereby.

6. The file of claim 1, wherein the first edge portions are staggered in a direction generally parallel to the hinge.

7. The file of claim 1, wherein the pocket panels are coiled in a same rotational direction around a common spine, which is affixed to the first covers at opposite sides thereof.

8. The file of claim 7, wherein the file is made from a single, unitary blank.

9. A file, comprising:

first and second cover panels pivotally connected to each other at a hinge for movement between an open and closed position, the cover panels overlapping each other in the closed position to contain papers of a predetermined size therebetween;

a plurality of superimposed pocket panels disposed on an inside of the first cover panel to define overlapping pockets, the pocket panels arranged and dimensioned to hold the papers so that the papers in the pockets are covered by the overlapping cover panels in the closed position, wherein the pocket panels have first edge portions that define openings to the pockets, the first edge portions being staggered with respect to one another in a direction generally parallel to the hinge, the pocket panels being connected portion with respect to the first cover panel to provide a first closed side of the pockets, and the plurality of pocket panels including an outermost pocket panel with a second connected portion connected to the cover panel to form a second closed side of at least one of the pockets; and a pocket tab extending from each of the pocket panels across the hinge from the first cover panel to the second cover panel and configured for displaying identification information for the respective pocket.

10. The file of claim 9, wherein the pocket panels have second edge portions defining the openings oriented at an angle to the first edge portions, and the pocket tabs extend from the second edge portions.

11. The file of claim 10, wherein the second edge portions are overlapping and substantially aligned.

12. The file of claim 10, wherein the plurality of pocket panels includes at least two inner pocket panels that are connected to the first cover panel only at the first connection portions, such that the outermost pocket panel retains the inner pocket panels between the outermost pocket panel and the first cover panel.

13. A file, comprising:

first and second cover panels pivotally connected to each other at a hinge for movement between an open and closed position, the cover panels overlapping each other in the closed position to contain papers of a predetermined size therebetween;

a first pocket panel connected to the first cover panel via a first fold;

a second pocket panel connected to the first pocket panel via a second fold; and a third pocket panel connected to the second pocket panel via a third fold;

wherein the second and third folds are oriented with respect to each other to cooperatively form parts of a pocket spine such that the pocket panels are stacked along the pocket spine and are superimposed on one another to define overlapping pockets arranged and dimensioned to hold the papers so that the papers in the pockets are covered by the overlapping cover panels in the closed position.

14. The file of claim 13, further comprising an attachment panel folded with respect to the pocket panels about an attachment fold and and affixed to the first cover panel.

15. The file of claim 13, wherein second and third pocket panels are folded about the pocket spine in a same rotational direction.

16. The file of claim 15, wherein the first second and third pocket panels are arranged as a coiled structure about the pocket spine.

17. The file of claim 13, wherein the first fold and the pocket spine form adjacent closed sides of at least some of the stacked pockets.

18. The file of claim 17, wherein the closed sides of the pockets are perpendicular to each other.

19. The file of claim 17, wherein the first fold forms a bottom closed side of the pockets, and the pocket spine forms a lateral closed side of the pockets.

20. The file of claim 13, wherein the second and third folds are aligned and are portions of a common fold line along the pocket spine.

21. The file of claim 13, further comprising an attachment panel connected to one of the pocket panels via another fold about the pocket spine, the attachment panel being affixed to the first cover panel such that the stacked pocket panels are collectively positioned against the first cover panel via the first fold and the spine is attached to the first cover panel via the attachment panel.

22. The file of claim 13, wherein the pocket panels and the first cover panel are of unitary construction.

23. The file of claim 13, further comprising a pocket tab extending from each of the pocket panels configured to display identification information for the respective pocket, the pocket tabs extending away from the pocket spine.

24. The file of claim 23, wherein the pocket tabs are staggered with respect to each other such that each of the pocket tabs is visible with the pockets closed.

25. The file of claim 24, further comprising a file tab extending from at least one of the cover panels further from the hinge than the pocket tabs.

26. The file of claim 13, wherein the pocket panels are staggered in a direction generally parallel to the hinge.

27. A filing device, comprising:

a first cover panel; and a coiled pocket structure including a spine and comprising:

a first pocket panel connected to the first cover panel via a first fold, a second pocket panel folded in a first rotational direction at a second fold about the pocket spine connecting the second pocket panel to the first pocket panel, and a third pocket panel folded in the first rotational direction at a third fold about the spine connecting the third pocket panel to the second pocket panel;

wherein the pocket panels are stacked along the pocket spine and are superimposed on one another to define overlapping pockets arranged over the first panel.

28. The filing device of claim 27, further comprising a second cover panel pivotally connected to the first cover panel other at a hinge for movement between an open and closed position to provide a file, the cover panels overlapping each other in the closed position to contain papers of a predetermined size therebetween, and the pockets being arranged and dimensioned to hold the papers that are covered by the overlapping cover panels in the closed position.

29. The filing device of claim 27, wherein the coiled pocket structure is positioned against the first cover panel via the first fold, and the spine is attached to the first cover panel at a location remote from the first fold.

30. The filing device of claim 27, wherein the pocket spine is attached to the first cover panel.

31. The filing device of claim 30, further comprising a attachment panel folded at the spine and affixed to the first cover panel.

32. The filing device of claim 30, wherein the attachment panel is connected to the coiled pocket structure via a connection fold associating the connection panel to the pocket panel of the coiled pocket structure disposed farthest from the first fold.

* * * * *